United States Patent [19]

Benedetti et al.

[11] Patent Number: 4,942,656

[45] Date of Patent: Jul. 24, 1990

[54] PLANT AND METHOD FOR THE TEMPERATURE-EQUALIZATION OF SLABS DOWNSTREAM OF A CONTINUOUS CASTING PLANT

[75] Inventors: Giampietro Benedetti, Campoformido; Bruno Di Giusto, Udine, both of Italy

[73] Assignee: Danieli & C. Officine Meccaniche SpA, Buttrio, Italy

[21] Appl. No.: 217,894

[22] Filed: Jul. 12, 1988

[30] Foreign Application Priority Data

Aug. 5, 1987 [IT] Italy ..... 83427 A/87

[51] Int. Cl.[5] ..... B21B 1/46

[52] U.S. Cl. ..... 29/527.6; 29/33 C; 29/527.7

[58] Field of Search ..... 164/476, 460, 477, 263, 164/417; 29/527.6, 527.7, 33 C

[56] References Cited

U.S. PATENT DOCUMENTS

| | | | |
|---|---|---|---|
| 4,217,095 | 8/1980 | Tokitsu | 29/527.7 X |
| 4,630,352 | 12/1986 | Ginzburg et al. | 164/417 X |
| 4,675,974 | 6/1987 | Connolly | 164/476 X |
| 4,698,897 | 10/1987 | Frommann et al. | 164/476 X |
| 4,829,656 | 5/1989 | Rohde | 29/527.7 |

FOREIGN PATENT DOCUMENTS

| | | |
|---|---|---|
| 1559355 | 3/1969 | France . |
| 2498092 | 7/1982 | France . |

OTHER PUBLICATIONS

Abstract of Japanese Patent Publication No. 57-168720, (Oct. 18, 1982).

Abstract of Japanese Patent Publication No. 58-163505, (Sep. 28, 1983).

Abstract of Japanese Patent Publication No. 58-221602, (Dec. 23, 1983).

Abstract of Japanese Patent Publication No. 59-94501, (May 31, 1984).

Cone, C., "Reheating Furnaces for Continuous Steelmaking," *Iron and Steel Engineer,* vol. 44, No. 9, pp. 119-126, Sep. 1967.

Wiesinger, H. et al., "Brammenwarmeinsatz und Direktwalzung", *Stahl u. Eisen,* vol. 104, No. 22, pp. 1161-1165, Oct. 29, 1984.

*Primary Examiner*—Nicholas P. Godici

*Assistant Examiner*—J. Reed Batten, Jr.

*Attorney, Agent, or Firm*—Wegner & Bretschneider

[57] ABSTRACT

The plant (10) includes a temperature-equalization furnace (16) and an inlet shears (12) and an outlet shears (17) positioned respectively at the inlet and outlet of the furnace. The furnace is equipped with inlet and outlet doors, and cooled rollers connected to a motor for driving them in an oscillatory motion. In a method of continuous strip rolling using such a plant, in the event of an obstacle in a rolling train (18), the part of slab (20) not yet rolled is sheared by the outlet shears, returned to the furnace and kept there until the obstacle has been removed. During retention in the furnace, the slab is kept in a to-and-fro movement by means of oscillatory rotation of the cooled rollers.

11 Claims, 3 Drawing Sheets

PLANT AND METHOD FOR THE TEMPERATURE-EQUALIZATION OF SLABS DOWNSTREAM OF A CONTINUOUS CASTING PLANT

This invention concerns a plant to equalize the temperature of slabs downstream of a continuous casting machine in a continuous plant for the rolling of coils. The invention concerns also a method which can be obtained with such a plant.

To be more exact, this invention concerns a plant to equalize the temperature of slabs downstream of a continuous casting process, such plant forming part of a continuous plant to roll strip.

The equalization plant is suitable also to meet requirements linked to obstacles in the rolling train and other auxiliary requirements and also requirements connected to the slowing down of output for any reason.

Temperature-equalization furnaces are known which entail a plurality of problems linked to the cold points which occur when a slab has to be halted momentarily before it can be sent forward for rolling.

This drawback of cold points is of greatest importance where it is necessary to roll slabs to obtain coils, namely continuous sheet, or strip of a small thickness, such strip possibly being also finally coiled in rolls.

It should be borne in mind that a slab halted in the equalization furnace has to remain therein at least for the time required for it to acquire a substantially constant temperature throughout its length and thickness.

This means that the equipment supporting the slab undergoes a considerable thermal stress, which is especially great when the support equipment consists of rollers.

The rollers which support the slabs in an equalization furnace are therefore cooled with water, but the points of contact between the rollers and the slab are precisely the cause of the cold points that give rise to unfavourable results in the subsequent rolling process and thereafter in the final result connected with the product itself.

Moreover, in a continuous processing line to produce strip starting from continuous casting there may be many reasons for halting production either in the continuous casting process or in the rolling train, accompanied by difficulties connected to the discharge of slabs coming from the casting line.

Such shortcomings become even more problematical when they occur in the rolling train since they hinder correct processing upstream.

The document "Iron and Steel, Vol. 44, No. 9 of September 1967, pages 119–126" illustrates a temperature-equalization plant for slabs downstream of a continuous casting process in an in-line plant for continuous production of strip, starting from a continuous casting machine, the plant comprising a temperature-equalization furnace and an inlet shears and outlet shears at the inlet and outlet of the furnace, the equalization furnace being equipped with entry and exit doors and cooled rolls.

The document "Patent Abstracts of Japan, Vol. 8, No. 207 (M-327) (1644)" discloses a method for the continuous rolling of strip, starting from a continuous casting process, whereby in the event of an obstacle in the rolling train the part of a slab which has still not been rolled is cut by shears, returned by the equalization furnace and kept there until the obstacle has been eliminated.

The invention therefore concerns in particular the continuous plants for rolling slabs to produce continuous sheet and/or strip, which may be coiled also in rolls, starting from continuous casting.

To obviate the above shortcomings and make considerable flexibility possible in plants which roll continuously the slabs produced by continuous casting so as to obtain continuous sheet or strip, the present applicant has studied and embodied this invention.

According to the invention an equalization furnace having inlet and outlet doors which can be shut is provided with a shears at its inlet and a shears at its outlet.

A measurement system able to read the length of a slab entering the furnace is provided in cooperation with the inlet of the equalization furnace.

This measurement system is enabled to actuate the inlet shears to carry out shearing when the length of the slab coincides with the value of the weight of the strip, or final roll of strip, which it is necessary to obtain.

According to the invention, after the slab has been sheared to size, it is accelerated within the equalization furnace by variable-speed driven rollers included in the furnace. This acceleration serves to distance the tail of the sheared slab from the head of the next slab.

The length of the equalization furnace is normally dimensioned in such a way that it can contain a slab sheared to size, plus a length corresponding to the time needed for the temperature of the slab to be made uniformly homogeneous, plus an interspace which is determined between the head and tail of two consecutive slabs.

When the required equalization of the temperature of the slab has been reached, the slab is moved forwards quickly and brought up to a speed very close to that of the first rolling stand of the hot-rolling mill, which will convert it into strip and then possibly will coil it.

According to the invention a heater to heat the edges of the slab is located upstream of the first rolling stand.

When any obstacle occurs in the hot-rolling mill and a part of a slab has still to be rolled while the other part is already between the rolling rolls, the invention works as follows.

The continuous casting machine is halted and the shears at the outlet of the furnace performs emergency shearing of the slab thus obstructed.

The segment of slab thus sheared while about to be rolled is returned to the furnace, whilst the segment of slab between the casting machine and the furnace is sheared and then introduced into the furnace.

The inlet and outlet doors at the ends of the furnace are shut so as to prevent loss of heat and oxidization of the two segments of slab in the furnace.

According to the invention, in such conditions the rollers of the furnace are caused to oscillate so as to avoid deformation of the rollers subjected to thermal stress.

The oscillation consists of a desired angular rotation in one direction, followed by a desired angular rotation in the opposite direction, and has the further purpose of preventing the formation, in the slabs parked within the equalization furnace, of cold points which create problems later during rolling.

According to the invention the rollers, which may be of an individually powered type, comprise replaceable wearing rings circumferentially, while they include lateral retention flanges advantageously.

When processing conditions have been restored and enable rolling to be re-started, the slabs kept in the furnace are rolled and provide underweight strip as compared to the strip which they should have provided, this being due to the fact that the strip has been produced with shorter slabs.

Instead, if for any reason the continuous casting machine has to continue producing, the invention provides a variant in which a discharge conveyor cooperating with a lateral traversing conveyor and with the inlet shears is positioned upstream of the equalization furnace.

In this case the slab coming from the continuous casting machine is sheared into segments of a desired length, for instance between two and three meters. These segments are traversed laterally and cooled until they reach a stacker, for example, so that they can be used thereafter in a conventional hot-rolling machine to produce sheet or other products.

The invention is therefore embodied with a plant for the temperature-equalization of slabs downstream of a continuous casting machine in a plant for the continuous production of strip, which may also be coiled in rolls. In accordance with the invention, the temperature-equalization plant includes a temperature equalization furnace and inlet and outlet shears at the inlet and outlet of the furnace, respectively. The furnace is equipped with inlet and outlet doors and cooled rollers which are capable of oscillatory rotation, and which may include replaceable retention flanges and wearing rings. A heater for heating the slab edges may be included downstream of the furnace. The plant may further include, upstream of the furnace, an inlet measurement means for controlling the inlet shears.

The invention is also obtained with a method which can be brought about with such plant. In the inventive method for continuous rolling of strip using such a plant, starting from continuous casting, in the event of an obstacle in a rolling train, the part of a slab not yet rolled is sheared by the outlet shears, returned to the furnace and kept there until the obstacle has been removed. The part of the slab thus retained in the furnace is kept in the furnace with a to-and-fro movement by means of an oscillatory rotation of the cooled rollers. Also in the event of an obstacle in the rolling train, the slab which has passed the inlet shears may be sheared and sent into the furnace, where it is kept with a lengthwise oscillatory movement while the continuous casting machine is halted. While such lengthwise oscillatory movement of the sheared slab is taking place in the furnace, the slab being formed by the continuous casting machine may be sheared into segments which are discharged laterally.

The attached figures, which are given as a non-restrictive example, show the following:

FIG. 1 gives a plan view of a plant according to the invention;

Figure 1:
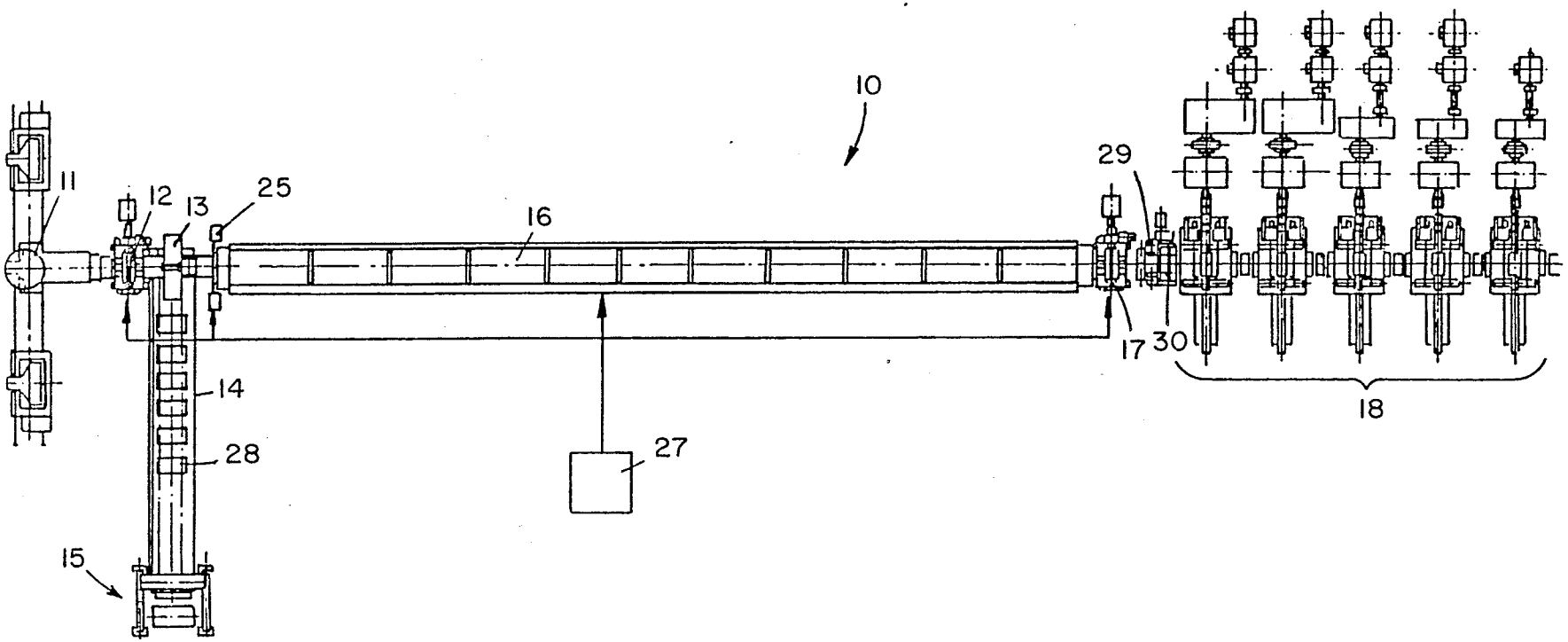
Figure 2:
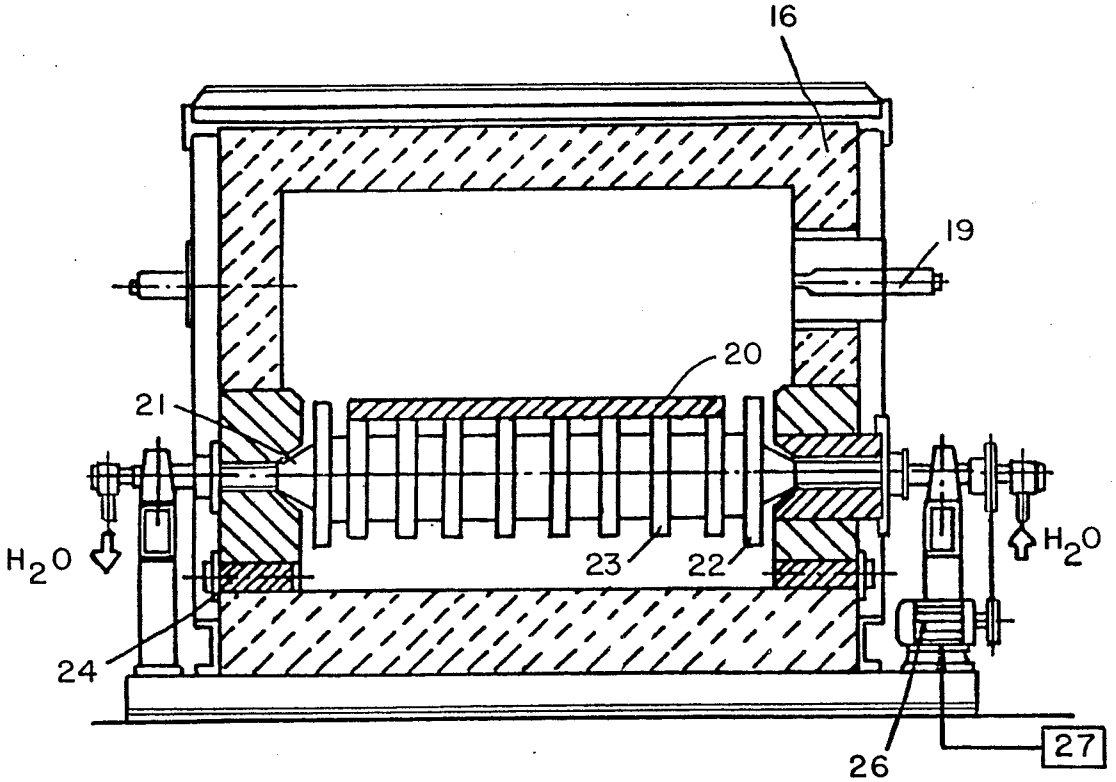
FIG. 2 shows a preferred section of the equalization furnace.
Figure 3:
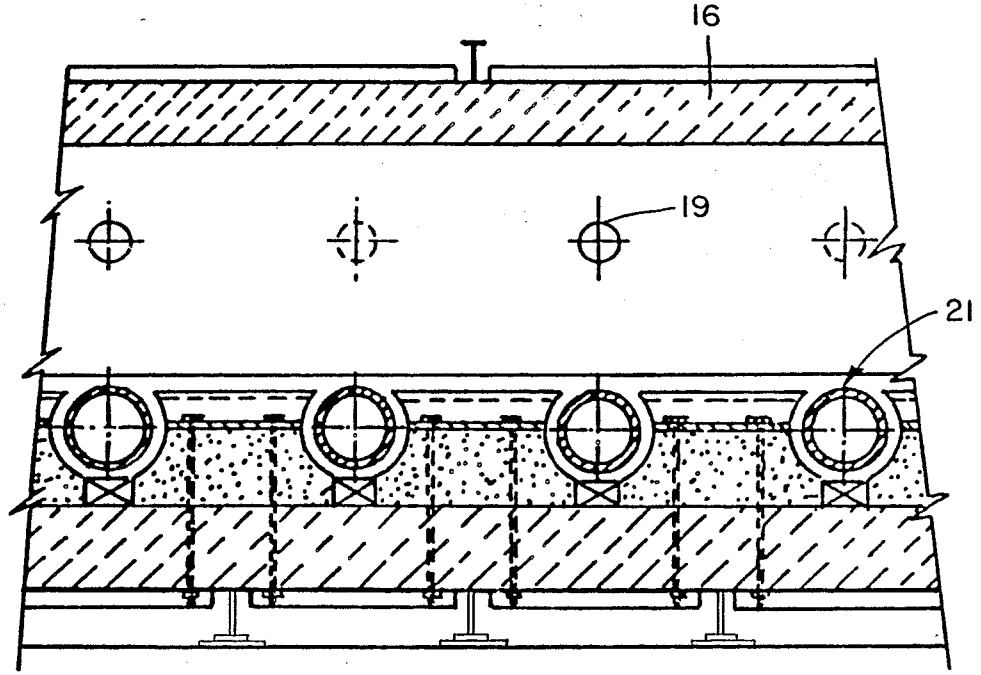
FIG. 3 shows a segment of the lengthwise section of the furnace of FIG. 1.

In the figures a temperature-equalization plant 10 is located downstream of a continuous casting machine 11 able to cast slabs 20 suitable to produce strip or strip coiled in rolls, the plant 10 cooperating with an inlet shears 12 and an equalization furnace 16.

The example given shows the equalization furnace 16 with the variant cited earlier, so that a lateral traversing conveyor 13 cooperating with a transfer conveyor 14 equipped at its end with a stacker 15 is included immediately downstream of the inlet shears 12.

A measurement system 25 is comprised in cooperation with the inlet shears 12 in a position upstream of the equalization furnace 16.

An outlet shears 17, downstream of which is positioned a rolling train 18 suitable to produce strip, is situated at the downstream end of the furnace 16.

A scaling machine 29 operating with a jet of fluid under pressure and a heater 30 to heat the edges of slabs 20 are located advantageously upstream of the rolling train 18. The heater 30 may comprise burners but is advantageously an induction heater.

The rolling plant shown in FIG. 1 is an in-line plant suitable to perform continuous rolling, starting with continuous casting and producing hot-rolled strip at its end.

The equalization furnace 16 is equipped with upper burners 19 above the slab 20 and lower burners 24 below the slab 20, drive rollers 21 being included within the furnace 16. In this example the drive rollers 21 are actuated by a motor 26 and cooled by circulation of water.

The cooled drive rollers 21 comprise replaceable wearing rings 23 circumferentially and replaceable retention flanges 22 laterally, the flanges being suitable to retain the slabs 20 laterally.

When the slab 20 coming from the continuous casting machine 11 begins to enter the furnace 16 at the casting speed, its length is read by a measurement system 25 cooperating with a control and data-processing unit 27.

When there is a correct relationship between the length of the slab 20 and the weight of the strip to be finally rolled, the data-processing unit 27 actuates the inlet shears 12 and causes a clean shear between the slab being cast and the segment of slab 20 already cast and possessing the required length.

When the slab 20 has been sheared to size, it is accelerated by the drive rollers 21, which receive an appropriate command from the data-processing unit 27. Such acceleration is needed to separate the sheared slab 20 from the slab being cast.

When the slab 20 within the furnace 16 has reached the required equalization of temperature, it is fed forwards swiftly at a speed very close to the speed of the first stand of the rolling train 18.

If any obstacle occurs in the rolling train 18 during rolling, the data-processing unit 27 actuates the outlet shears 17, which separates the segment of slab in the rolling train 18 from the segment still present in the equalization furnace 16.

The segment still in the furnace 16 is retracted therein and the inlet and outlet doors of the furnace 16 are shut.

If for any reason the continuous casting machine 11 has to continue working, the cast slab is sheared into segments, thus providing plates 28 which are discharged by the lateral traversing conveyor 13 onto the transfer conveyor 14 and cooled until they arrive, already cooled, at the stacker 15.

The plates 28 are then transferred from the stacker 15 to a plant which rolls them into sheet or other products, for instance.

In the meantime the slabs 20 in the equalization furnace 16 are provided with a to-and-fro oscillatory movement, whereby the cooled rollers 21 carry out substantially, for example, a complete revolution in one direction and then substantially a complete revolution in the other direction.

This movement has the effect that the slab 20 advances and retreats substantially by a length equal to the development of a complete revolution of the wearing rings 23 on which the slab 20 is supported.

This to-and-fro oscillatory movement has the result that, owing to the action of the upper and lower burners 19 and 24, the slab 20 does not develop cold points which would otherwise give rise to an unsuitable final product during processing.

What is claimed is:

1. In a plant for continuously producing strip from a continuous casting machine, the improvement comprising a temperature-equalization plant comprising:

a temperature-equalization furnace having an inlet door and an outlet door;

rollers rotatably mounted for oscillatory movement in said temperature-equalization furnace, means for cooling said rollers, and drive means for driving said rollers to move slab material forward in the temperature-equalization furnace, said drive means including means for driving the rollers in an oscillatory movement in one angular direction and then an opposite angular direction whereby slab material is oscillated to-and-fro while being retained within the temperature-equalization furnace;

an inlet shears upstream of said inlet door of the temperature-equalization furnace; and an outlet shears downstream of said outlet door of the temperature-equalization furnace.

2. A plant as recited in claim 1, further comprising a heater means downstream of the outlet door of said temperature-equalization furnace, said heater means for heating edges of the slab material.

3. A plant as recited in claim 1, wherein said rollers include retention flanges to laterally retain the slab material.

4. A plant as recited in claim 1, wherein said rollers include wearing rings to support the slab material.

5. A plant as recited in claim 1, further comprising inlet measurement means for measuring the length of slab material entering said temperature-equalization furnace, and control means operatively connected to said inlet measurement means and to said inlet shears, said control means for actuating the inlet shears to shear the slab material in response to the measured length from the inlet measurement means.

6. A plant as recited in claim 5, wherein said control means is operatively connected to said drive means for accelerating said rollers after the slab material has been sheared by the inlet shears.

7. A plant as recited in claim 5, further comprising a rolling train downstream of said outlet shears, wherein said control means is operatively connected to said outlet shears for actuating the outlet shears when an obstacle occurs in the rolling train during rolling.

8. A plant as recited in claim 5, further comprising a lateral traversing conveyor means downstream of said inlet shears for laterally discharging sheared slab material from said inlet shears.

9. A method for continuously producing rolled strip from slab received from a continuous casting machine, comprising shearing slab from a continuous casting plant with an inlet shears into slab segments, heating to equalize the temperature of the slab segments in a temperature-equalization furnace having an inlet door, an outlet door, and cooled drive rollers supporting the slab segments, and rolling the heated slab segments in a rolling train, the improvement wherein in the event of an obstacle in the rolling train, the slab segments from the temperature-equalization furnace not yet rolled are sheared from the rolled slab segments by outlet shears, returned to the temperature-equalization furnace and retained in the temperature-equalization furnace in to-and-fro oscillatory movement upon the cooled drive rollers until the obstacle has been removed.

10. A method for continuously producing rolled strip as recited in claim 9, wherein in the event of said obstacle in the rolling train, the continuous casting machine is halted and the slab between the continuous casting machine and the temperature-equalization furnace is sheared into slab segments by the inlet shears, introduced into the temperature-equalization furnace, and retained in the temperature-equalization furnace in lengthwise oscillatory movement upon the cooled drive rollers until the obstacle has been removed.

11. A method for continuously producing rolled strip as recited in claim 9, wherein in the event of said obstacle in the rolling train when the continuous casting machine continues operating, the slab segments from the inlet shears are introduced into the temperature-equalization furnace, and retained in the temperature-equalization furnace in lengthwise oscillatory movement upon the cooled drive rollers, while the slab from the continuous casting machine is sheared by the inlet shears into plates which are discharged laterally, until the obstacle has been removed.

* * * * *